US008384599B2

(12) United States Patent
Carr

(10) Patent No.: US 8,384,599 B2
(45) Date of Patent: Feb. 26, 2013

(54) MULTIPLE-CAVITY ANTENNA

(76) Inventor: William N. Carr, Montclair, NJ (US)

( * ) Notice: Subject to any disclaimer, the term of this patent is extended or adjusted under 35 U.S.C. 154(b) by 547 days.

(21) Appl. No.: 12/621,451

(22) Filed: Nov. 18, 2009

(65) Prior Publication Data

US 2010/0066636 A1 Mar. 18, 2010

Related U.S. Application Data

(63) Continuation-in-part of application No. 12/535,768, filed on Aug. 5, 2009, now Pat. No. 8,284,104.

(60) Provisional application No. 61/207,467, filed on Feb. 13, 2009, provisional application No. 61/273,814, filed on Aug. 10, 2009.

(51) Int. Cl.
*H01Q 1/38* (2006.01)

(52) U.S. Cl. ..... 343/700 MS; 343/793; 343/702; 343/797; 343/810

(58) Field of Classification Search ..... None
See application file for complete search history.

(56) References Cited

U.S. PATENT DOCUMENTS

| | | | | |
|---|---|---|---|---|
| 4,128,840 | A | 12/1978 | Tucker | |
| 4,259,670 | A | 3/1981 | Schiavone | |
| 4,356,492 | A | 10/1982 | Kaloi | |
| 4,704,581 | A | 11/1987 | Clark | |
| 4,783,661 | A | 11/1988 | Smith | |
| 5,283,589 | A | 2/1994 | Blevins | |
| 5,341,148 | A | 8/1994 | Walter et al. | |
| 5,471,180 | A | 11/1995 | Brommer et al. | |
| 5,995,048 | A | 11/1999 | Smithgall et al. | |
| 6,342,864 | B1 | 1/2002 | Muramoto et al. | |
| 6,552,693 | B1 | 4/2003 | Leisten | |
| 6,975,276 | B2 | 12/2005 | Brown | |
| 7,019,711 | B2 | 3/2006 | Johnson et al. | |
| 7,034,752 | B2 * | 4/2006 | Sekiguchi et al. | 343/700 MS |
| 7,088,290 | B2 | 8/2006 | Ohno et al. | |
| 7,173,577 | B2 | 2/2007 | Brown et al. | |
| 7,388,550 | B2 | 6/2008 | McLean | |
| 7,471,247 | B2 | 12/2008 | Saily et al. | |
| 7,589,678 | B2 * | 9/2009 | Perunka et al. | 343/702 |
| 7,619,570 | B1 | 11/2009 | Sarehraz et al. | |
| 2002/0057222 | A1 | 5/2002 | McKinzie, III et al. | |
| 2002/0167282 | A1 | 11/2002 | Kirkpatrick et al. | |
| 2003/0058178 | A1 | 3/2003 | Von Alpen et al. | |
| 2003/0169204 | A1 | 9/2003 | Saito | |
| 2003/0201942 | A1 * | 10/2003 | Poilasne et al. | 343/702 |
| 2003/0210190 | A1 * | 11/2003 | Lai | 343/702 |
| 2004/0021605 | A1 | 2/2004 | Kouam et al. | |

(Continued)

FOREIGN PATENT DOCUMENTS

WO 2004093249 A1 10/2004

OTHER PUBLICATIONS

Young, Lee W., "PCT Application No. PCT/US 10/00441 International Search Report Apr. 7, 2010", , Publisher: PCT, Published in: PCT.

Young, Lee W., "PCT Application No. PCT/US 10/00424 International Search Report Apr. 9, 2010", , Publisher: PCT, Published in: PCT.

(Continued)

*Primary Examiner* — Trinh Dinh

(74) *Attorney, Agent, or Firm* — Kaplan, Breyer, Schwarz & Ottesen, LLP

(57) ABSTRACT

An antenna for a Radio-Frequency IDentification (RFID) system is disclosed that comprises a pair of resonant cavities. The antenna is realized by folding the ends of a ribbon of conductive material, such as metal foil, over the middle part of the ribbon. The antenna generates a higher voltage than prior-art antennas used in RFID systems, and it makes possible RFID systems with an improved range. In an alternative embodiment, the antenna comprises a reflector that enables the RFID system to better tolerate the presence of nearby metal objects.

27 Claims, 5 Drawing Sheets

Dual-cavity antenna with load element 500

U.S. PATENT DOCUMENTS

| | | | | |
|---|---|---|---|---|
| 2004/0070541 | A1 | 4/2004 | Andersson et al. | |
| 2005/0057415 | A1 | 3/2005 | Rawnick et al. | |
| 2006/0181475 | A1* | 8/2006 | Kwon et al. | 343/793 |
| 2007/0109201 | A1 | 5/2007 | Licul et al. | |
| 2007/0210976 | A1* | 9/2007 | Luk et al. | 343/793 |
| 2007/0290941 | A1 | 12/2007 | Brown et al. | |
| 2008/0122631 | A1 | 5/2008 | Kodukula et al. | |
| 2008/0191950 | A1 | 8/2008 | Chang et al. | |
| 2008/0284656 | A1* | 11/2008 | Petropoulos | 343/700 MS |
| 2010/0013718 | A1* | 1/2010 | Zhu et al. | 343/702 |
| 2010/0207840 | A1* | 8/2010 | Carr | 343/904 |
| 2010/0207841 | A1* | 8/2010 | Carr | 343/906 |

OTHER PUBLICATIONS

Islam, Hasan Z., "U.S. Appl. No. 12/535,768 Office Action Mar. 2, 2012", , Publisher: USPTO, Published in: US.

Athina Nickitas-Etienne, "PCT Application No. PCT/US2010/000441 International Preliminary Report on Patentability", , Publisher: PCT, Published in: PCT Aug. 25, 2011.

Beate Giffo-Schmitt, "PCT Application No. PCT/US2010/000424 International Preliminary Report on Patentability", , Publisher: PCT, Published in: PCT , Aug. 25, 2011.

Carr, William N., "U.S. Appl. No. 12/462,428, filed Aug. 5, 2009", , Publisher: USPTO, Published in: US.

* cited by examiner

Monopole antenna 100 resonant structure 200

Folded-dipole antenna 300

Single-cavity antenna with load element 400

Dual-cavity antenna with load element 500

Dual-cavity antenna with non-equal cavities 600

Dual-cavity antenna with reflector 700

Dual-cavity antenna with dielectric 800

Dual-cavity antenna with multiple dielectrics and reflector 900

Dual-cavity antenna with delay elements 1000

MULTIPLE-CAVITY ANTENNA

CROSS REFERENCE TO RELATED APPLICATIONS

The underlying concepts, but not necessarily the language, of the following cases are incorporated by reference:

(1) U.S. provisional application No. 61/207,467; and (2) U.S. provisional application No. 61/273,814.

If there are any contradictions or inconsistencies in language between this application and one or more of the cases that have been incorporated by reference that might affect the interpretation of the claims in this case, the claims in this case should be interpreted to be consistent with the language in this case.

This case claims benefit of the following provisional applications:

(1) U.S. provisional application No. 61/207,467; and (2) U.S. provisional application No. 61/273,814.

This case is a Continuation-in-Part and claims priority of co-pending U.S. case No. 12/535,768 titled "Multiple-Resonator Antenna" and filed on Aug. 5, 2009.

FIELD OF THE INVENTION

The present invention relates to antenna design for radio communication in general, and, more particularly, to antenna design for Radio-Frequency IDentification (RFID) systems.

BACKGROUND OF THE INVENTION

Radio communication systems have existed for over a century. During this period of time, antenna designers have generated a wide variety of antenna designs with the goal of achieving good performance in a variety of operating conditions.

Generally, the goal of the antenna designer when designing, for example, a receiving antenna, is to maximize power transfer between an electromagnetic signal incident on the antenna, and the resulting electrical signal generated by the antenna. The higher the power transfer, the higher the received signal-to-noise ratio, which usually results in better receiver performance.

Also, traditionally, radio receivers have comprised electronic circuitry and a separate receiving antenna interconnected to one another through a suitable cable connection. In such systems, antenna designers must consider the distorting influence of the cable connection and the electronic circuitry on the electromagnetic behavior of the antenna.

More recently, with the advent of small radio systems based on integrated circuit technology, it has become possible to make so-called Radio-Frequency IDentification (RFID) systems, wherein an entire radio receiver is housed in a package much smaller than the receiving antenna. In such systems, the almost-complete elimination of the distorting influence of the cable connection and the electronic circuitry enables novel antenna designs.

So-called passive RFID receivers can be much smaller than the receiving antenna in part because they do not require a power supply. Power to operate the receiver is derived from the received radio signal itself. The signal generated by the receiving antenna is rectified by one or more diodes to yield a direct-current (DC) voltage that is used to power the receiver.

Ideal diodes are perfect conductors when a forward voltage is applied and are perfect insulators when a reverse voltage is applied. Real diodes only approximate this behavior. In particular, real diodes require a minimum forward voltage before becoming good conductors. Accordingly, the signal generated by the receiving antenna, must have a voltage higher than the minimum required by the diodes, before a DC voltage becomes available to power the RFID receiver.

So, in contrast with traditional antenna design, the goal for the design of passive-RFID-receiver antennas is to maximize not the received-signal power, but rather the received-signal voltage.

It is well known in the art that antennas are reciprocal devices, meaning that an antenna that is used as a transmitting antenna can also be used as a receiving antenna, and vice versa. Furthermore, there is a one-to-one correspondence between the behavior of an antenna used as a receiving antenna and the behavior of the same antenna used as a transmitting antenna. This property of antennas is known in the art as "reciprocity."

An antenna used as a transmitting antenna accepts an electrical signal applied at an input port and produces a transmitted electromagnetic signal that propagates through three-dimensional space. It is well known in the art how to represent such a transmitted electromagnetic signal as a vector in a vector space, for example, as a superposition of spherical harmonics. The behavior of a transmitting antenna at a given frequency can be fully characterized by reporting, for example, the spherical-harmonic components of the transmitted electromagnetic signal that it generates in response to a test electrical signal at that frequency that is applied to the antenna's input port.

Such a characterization can be used to derive, unambiguously, the behavior of the same antenna when it is used as a receiving antenna. In this case, the input port becomes an output port that generates an output electrical signal in response to an incident electromagnetic signal propagating through three-dimensional space. The incident electromagnetic signal can be specified by, for example, by specifying its spherical-harmonic components. The resulting electrical signal can then be derived through a scalar product with the spherical-harmonic components of the transmitted electromagnetic signal at the same frequency, as is well known in the art.

A consequence of reciprocity is that an antenna can be fully characterized in terms of its properties as either a transmitting antenna or as a receiving antenna. A full characterization of an antenna when used in one mode (transmitting or receiving) uniquely and unambiguously defines the properties of the antenna when used in the other mode.

For example, in order to understand or measure the radiation pattern of an antenna it is frequently easier to feed an electric signal into the antenna and then observe the electromagnetic field generated by the antenna. This task can be performed experimentally or computationally. The radiation pattern of the antenna that is obtained through this method also applies when the antenna is used as a receiving antenna. Hereinafter, antennas will be interchangeably referred to as receiving or transmitting, and their properties will be discussed as they apply to either transmission or reception, as convenient to achieve clarity. It will be clear to those skilled in the art how to apply what is said about an antenna used in one mode (receiving or transmitting) to the same antenna used in the other mode.

FIG. 1 depicts monopole antenna 100 in accordance with the prior art. Monopole antenna 100 comprises monopole 110, ground plane 120 and co-axial cable connection 130. Monopole antenna 100 is a very common type of antenna and is representative of how many antennas operate. When an electrical signal is applied to co-axial cable connection 130, an electric field appears between monopole 110 and ground plane 120. If the electrical signal has a frequency at or near the so-called "resonant" frequency of the antenna, a large fraction of the power of the electrical signal is converted into an electromagnetic signal that is radiated by the antenna. If the electrical signal has a frequency that is substantially different from the resonant frequency of the antenna, a relatively small fraction of the signal's power is radiated; most of the power is reflected back into the co-axial cable connection.

In principle, it is possible to make an antenna that radiates efficiently at many frequencies, without exhibiting a band of resonance. In practice, it is difficult to make such antennas, and resonant structures (hereinafter also referred to as "resonators") are commonly used to make antennas that radiate efficiently.

FIG. 2 depicts resonant structure 200, which is an example of a type of resonant structure commonly used to make antennas in the prior art. Resonant structure 200 comprises a length of wire 240 bent in the shape of the letter U, with an input-output port 220 comprising connection points 230-1 and 230-2. As depicted in FIG. 2, the two connection points are attached to the two ends of the wire.

The frequency of resonance of resonant structure 200 depends on its length. The structure can be modeled as a twin-lead transmission line 210 with a short at one end (i.e., the end opposite input-output port 220). The structure is resonant at a frequency for which the length of the transmission line is about one quarter of a wavelength. The range of frequencies near the resonant frequency over which the resonant structure exhibits acceptably good performance is known as the "band of resonance."

Resonant structure 200 exhibits resonance in a manner similar to monopole antenna 100. Near the resonant frequency, the electromagnetic fields generated by the voltages and currents on wire 240 become stronger, and a larger fraction of the power of an electrical signal applied to input-output port 220 is radiated as an electromagnetic signal. Accordingly, resonant structures that exhibit this behavior are referred to as "electromagnetically-resonant."

FIG. 3 depicts folded-dipole antenna 300, which is an example of a common type of antenna in the prior art. Folded-dipole antenna 300 can be modeled as being composed of two instances of resonant structure 200 connected in series. When used as a transmitting antenna, an electrical signal is applied through balanced transmission line 320.

Although folded-dipole antenna 300 can be modeled as being composed of two instances of resonant structure 200 connected in series, the signal that it generates when used as a receiving antenna is not the sum of the signals that each instance of resonant structure 200 would generate if used by itself because of the mutual coupling between the two instances of resonant structure 200.

FIG. 4 depicts antenna-with-load-element 400, which is an example of a type of antenna in the prior art for RFID systems known as RFID tags. Antenna-with-load-element 400 comprises: conductive sheets 410-1, and 410-2, electrical connection 420, connection points 440-1 and 440-2, and load element 430, interrelated as shown.

Conductive sheets 410-1 and 410-2, together with electrical connection 420, form resonant structure 450. Load element 430 receives the signal generated by resonant structure 450 through connection points 440-1 and 440-2. When used to implement an RFID tag, load element 430 is small relatively to the size of conductive sheets 410-1 and 410-2.

To implement an RFID tag, load element 430 acts as both a receiver and a transmitter. In particular, in a passive RFID tag, transmission is accomplished through a technique known as "modulated backscatter" wherein load element 430 controls the impedance that it presents to the received signal. Modulated backscatter is based on the fact that, in any radio receiver, a portion of the electromagnetic signal incident on the receiving antenna is reflected. The amplitude and phase of the reflected signal depend on the impedance connected to the antenna port, so that load element 430 modulates the reflected signal by controlling its own impedance.

SUMMARY OF THE INVENTION

Embodiments of the present invention comprise a pair of resonant structures implemented as resonant cavities. Cavities are realized by interconnecting sheets of conductive material such as, for example, metal foil. Two cavities are combined to achieve an antenna structure that, when used as a receiving antenna, has a source impedance that is higher than prior-art antennas. For a given received signal strength, the higher source impedance yields a higher voltage at the antenna output port, resulting in a longer distance of operation for RFID tags based on the present invention.

An embodiment of the present invention comprises a ribbon of conductive material, such as metal foil, wherein the two ends of the ribbon are folded over the middle part of the ribbon. Between each folded end of the ribbon and the middle part of the ribbon there is a layer of supporting material that supports the ribbon and maintains the folded end of the ribbon at a fixed distance from the middle part of the ribbon. The volume of space between one end of the ribbon and the middle part of the ribbon, which is occupied by the supporting material, forms one electromagnetically-resonant cavity. The supporting material also acts as dielectric.

A load element is connected between the two folded ends of the ribbon to make an RFID tag. The folded ribbon is the tag's antenna; it has a higher impedance than prior-art antennas for RFID tags, with the result that a higher voltage is generated across the load element.

For situations where an RFID tag is used near a large metal object, embodiments of the present invention comprise an additional sheet of conductive material, referred to as a "reflector." For embodiments implemented as a folded ribbon, the reflector sheet is placed parallel to the middle part of the ribbon, on the side opposite the folded ends. A layer of supporting material is between the reflector and the middle part of the ribbon and serves to maintain a fixed distance between them. The presence of the reflector reduces the disruption of tag performance caused by large metal objects in the vicinity of the tag.

DETAILED DESCRIPTION

Figure 1:
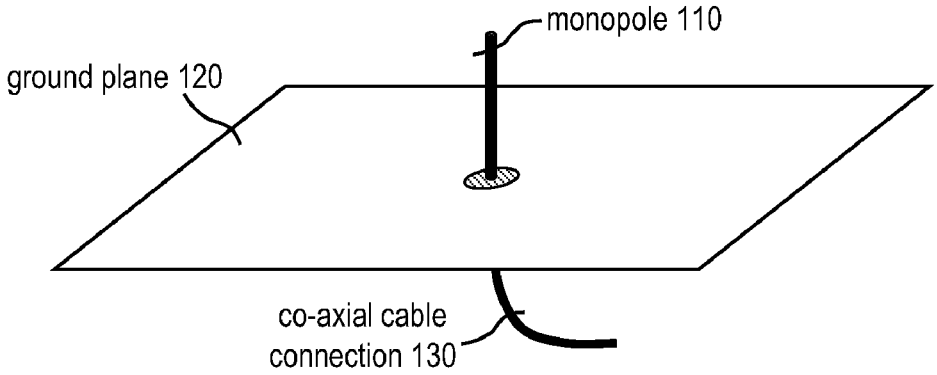
FIG. 1 PRIOR ART
FIG. 1 depicts a monopole antenna in the prior art.
Figure 2:
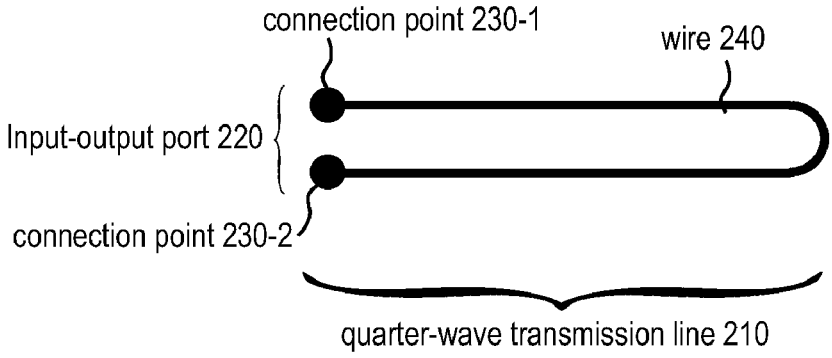
FIG. 2 PRIOR ART
FIG. 2 depicts a resonant structure in the prior art.
Figure 3:
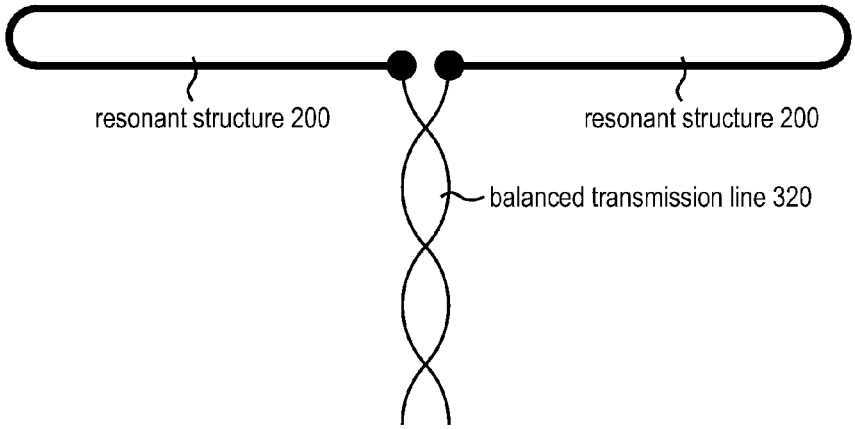
FIG. 3 PRIOR ART
FIG. 3 depicts a folded-dipole antenna in the prior art.
Figure 4:
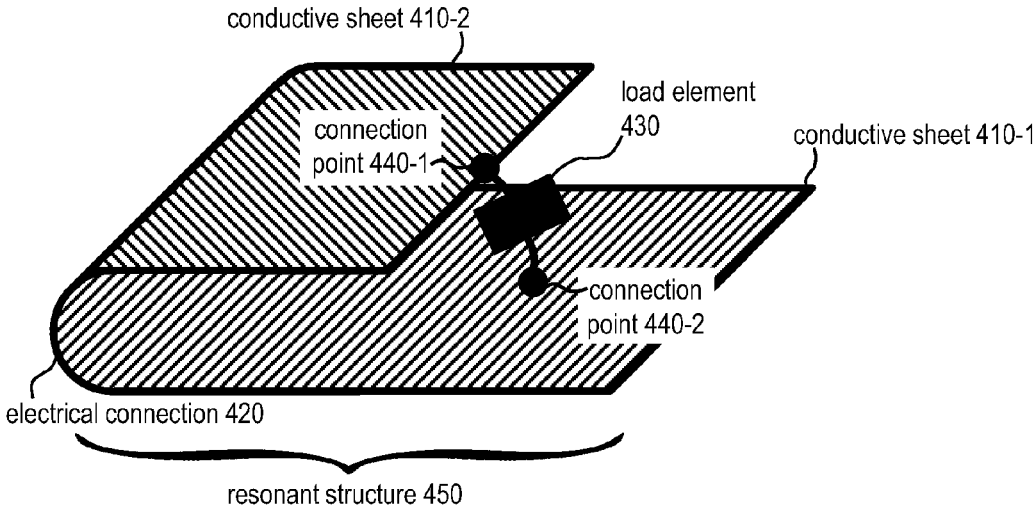
FIG. 4 PRIOR ART
FIG. 4 depicts an example of a type of antenna in the prior art for RFID tags.
Figure 5:
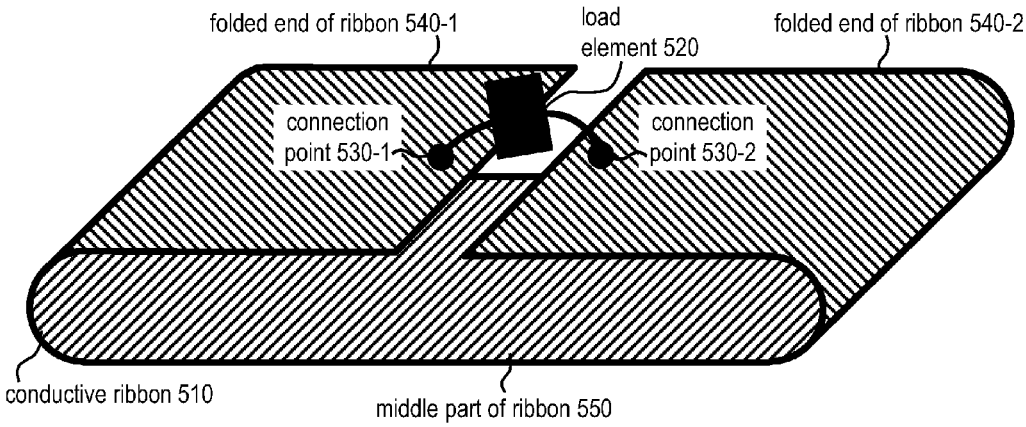
FIG. 5 depicts a dual-cavity antenna with a load element in accordance with a first illustrative embodiment of the present invention.

FIG. 5 depicts dual-cavity-antenna-with-load-element 500 in accordance with a first illustrative embodiment of the present invention. Dual-cavity-antenna-with-load-element 500 comprises: conductive ribbon 510, load element 520, and connection points 530-1 and 530-2 interrelated as shown. In particular, the two ends, 540-1 and 540-2, of conductive ribbon 510, are folded over the middle part 550 of conductive ribbon 510 and they are on the same side of the middle part 550 of conductive ribbon 510. The two folded ends 540-1 and 540-2 do not touch one another. Connection points 530-1 and 530-2 are on the two folded ends, 540-1 and 540-2, of conductive ribbon 510.

Each of the two folded ends 540-1 and 540-2 forms a resonant cavity together with the middle part 550 of conductive ribbon 510. The two cavities are electrically connected together via the shared middle part 550 of conductive ribbon 510. Compared to prior-art folded-dipole antenna 300, dual-cavity antenna with load element 500 has a higher impedance. In traditional radio systems, the higher impedance is not an advantage—indeed, in many traditional radio systems it is a disadvantage—but the higher impedance is advantageous in passive RFID tags. The use of a conductive ribbon to form two cavities, instead of using two resonant structures formed by a wire, is a salient difference between folded-dipole antenna 300 and dual-cavity antenna with load element 500; this difference gives the latter antenna the advantageous higher impedance. The other illustrative embodiment of the present invention set forth in this disclosure also provide the advantage of a higher impedance.

Although the two cavities formed by the two folded ends 540-1 and 540-2 are depicted in FIG. 5 as equal to one another, it will be clear to those skilled in the art, after reading this disclosure, how to make and use alternative embodiments of the present invention wherein the two cavities are different.

Although connection points 540-1 and 540-2 are depicted in FIG. 5 as being placed near the center of folded ends of ribbon 540-1 and 540-2, respectively, it will be clear to those skilled in the art, after reading this disclosure, how to make and use alternative embodiments of the present invention wherein the connection points are in different places. For example and without limitation, connection points 540-1 and 540-2 can be near corners of folded ends of ribbon 540-1 and 540-2.

Although connection points 540-1 and 540-2 are depicted in FIG. 5 as direct electrical connections such as are known in the art as "ohmic" connections, it will be clear to those skilled in the art, after reading this disclosure, how to make and use alternative embodiments of the present invention wherein the connection points are realized differently. For example and without limitation, connection points 540-1 and 540-2 can comprise capacitors or inductors or more complex impedance-matching networks.

Although the portions of conductive ribbon 510 wherein the folds occur are depicted as semicircular in shape, it will be clear to those skilled in the art, after reading this disclosure, how to make and use alternative embodiments of the present invention with folds having different shapes. For example, and without limitation, FIG. 8 below depicts an alternative embodiment of the present invention that can be implemented by folding a conductive ribbon in a different manner.

Figure 6:
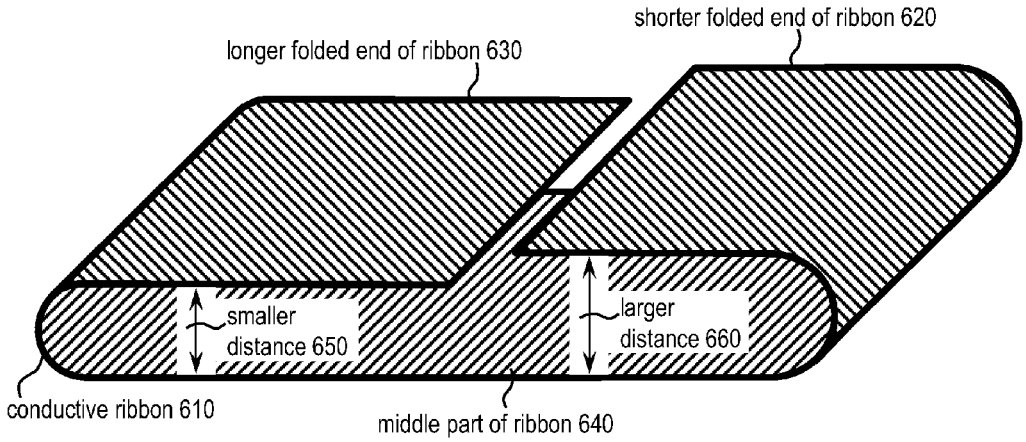
FIG. 6 depicts a dual-cavity antenna with non-equal cavities in accordance with a second illustrative embodiment of the present invention.

FIG. 6 depicts dual-cavity-antenna-with-non-equal-cavities 600 in accordance with a second illustrative embodiment of the present invention wherein the two cavities are not equal. As with the first illustrative embodiment, this antenna comprises a conductive ribbon 610, whose ends, 620 and 630, are folded over the middle part 640 of the ribbon. However, folded end 630 is longer than folded end 620, and folded end 630 is at a distance 650 from middle part of ribbon 640 that is less than the distance 660 between the shorter folded end of the ribbon 620 and the middle part of the ribbon 640.

For the purpose of visual clarity, FIG. 6 does not show connection points or a load element. Such elements in the second illustrative embodiment are identical to the corresponding elements in the first illustrative embodiment and should be understood to be present even though they are not depicted in FIG. 6. It will be clear to those skilled in the art, after looking at FIG. 5 and reading this disclosure, how to place connection points and how to attach a load element to dual-cavity antenna with non-equal cavities 600 in a manner similar to the manner shown in FIG. 5 for dual-cavity antenna with load element 500. Hereinafter, for the purpose of visual clarity, other figures that depict alternative embodiments of the present invention will also not explicitly show connection points or a load element. It will be understood that connection points and a load element are also present in all such embodiments, and it will be clear to those skilled in the art, after looking at FIG. 5 and reading this disclosure, how to place connection points and how to attach a load element, in such embodiments, in a manner similar to the manner shown in FIG. 5 for dual-cavity antenna with load element 500.

Although, in FIG. 6, the two cavities differ from one another because the lengths of folded ends 620 and 630 are different, and because distances 650 and 660 are different, it will be clear to those skilled in the art, after reading this disclosure, how to make and use alternative embodiments of the present invention wherein the two cavities differ from one another in other ways. For example, and without limitation, the two cavities can differ by:

i. having different lengths,
ii. having different widths,
iii. the two folded ends having different distances from the middle part of the ribbon,
iv. being made of different conductive materials,
v. having different shapes,
vi. comprising different dielectric materials,
vii. comprising different amounts of dielectric materials,
viii. comprising different combinations of multiple dielectric materials,
ix. having different corners,
x. having differently-finished edges, or
xi. a combination of i, ii, iii, iv, v, vi, vii, viii, ix, or x.

Figure 8:
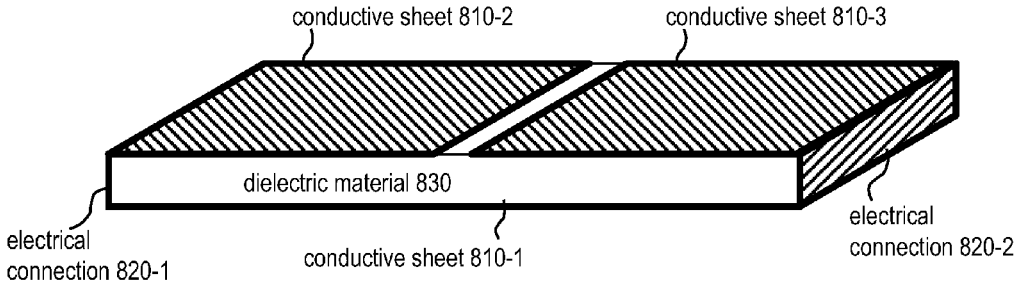
FIG. 8 depicts a dual-cavity antenna with a dielectric in accordance with a fourth illustrative embodiment of the present invention.

Although values for distance 650 and distance 660 are not explicitly specified in FIG. 8, it will be clear to those skilled in the art, after reading this disclosure, how to make and use embodiments of the present invention with specific values for distance 650 and distance 660. For example, and without limitation, both distances might be less than:

(i) the length of the ribbon, and
(ii) the width of the ribbon.

Also, for example and without limitation, the values for distance 650 and distance 660 might within the range of 3 mm to 10 mm, inclusive; the length of the ribbon might be within the range of 200 mm and 300 mm, inclusive; and the width of the ribbon might be no less than 6 mm.

Figure 7:
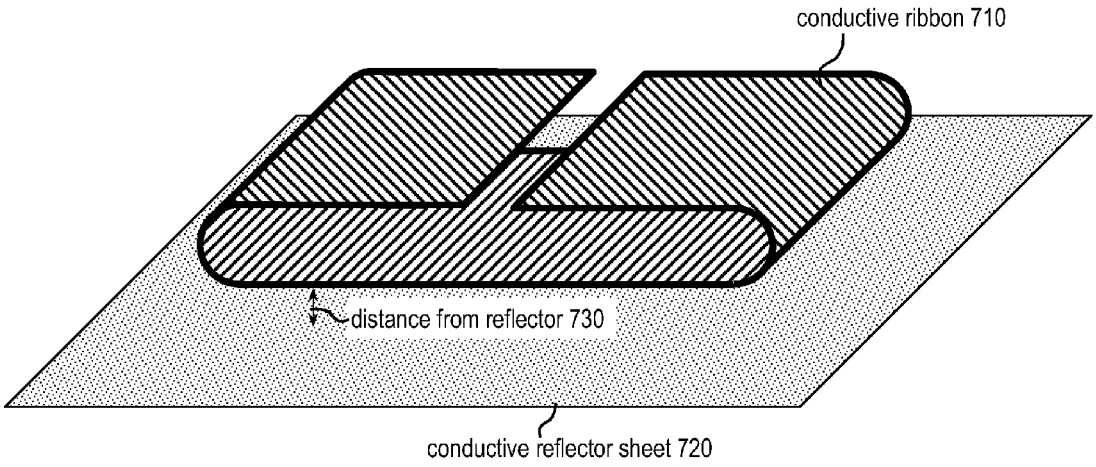
FIG. 7 depicts a dual-cavity antenna with a reflector in accordance with a third illustrative embodiment of the present invention.

FIG. 7 depicts dual-cavity-antenna-with-reflector 700 in accordance with a third illustrative embodiment of the present invention. Dual-cavity-antenna-with-reflector 700 comprises conductive ribbon 710 and conductive reflector sheet 720. Conductive ribbon 710 implements a dual-cavity antenna in accordance with the first illustrative embodiment or in accordance with the second illustrative embodiment set forth above.

Figure 9:
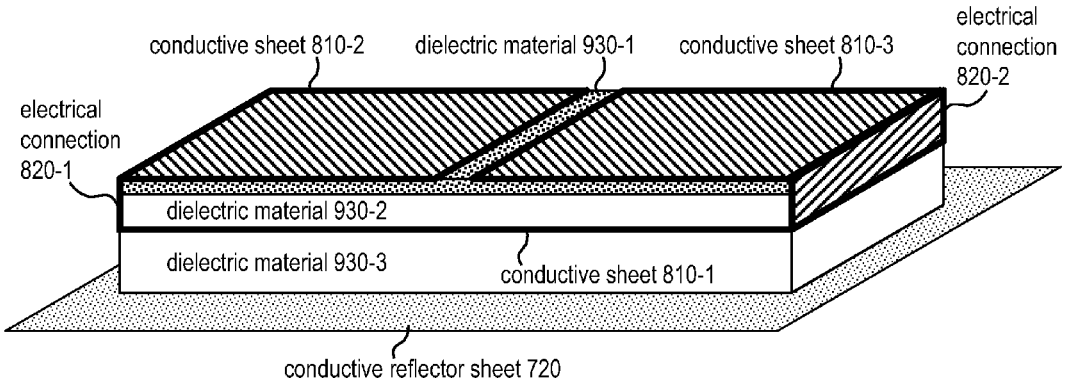
FIG. 9 depicts a dual-cavity antenna with multiple dielectrics and a reflector in accordance with a fifth illustrative embodiment of the present invention.

Although FIG. 7 shows conductive ribbon 710 as having the same shape as conductive ribbon 510 as depicted in FIG. 5, it will be clear to those skilled in the art, after reading this disclosure, how to make and use alternative embodiments of a dual-cavity antenna with reflector in accordance with the present invention wherein conductive ribbon 710 has the same shape as conductive ribbon 610 as depicted in FIG. 6. Furthermore, it will also be clear to those skilled in the art, after reading this disclosure, how to make and use alternative embodiments of a dual-cavity antenna with reflector in accordance with the present invention wherein conductive ribbon 710 is replaced by one of the alternative embodiments of a dual-cavity antenna according set forth in this disclosure. For example, and without limitation, one such embodiment of a dual-cavity antenna with reflector is depicted in FIG. 9 below.

Although conductive reflector sheet 720 is depicted as a thin sheet, as might be implemented with metal foil, that extends slightly beyond the outline of conductive ribbon 710, it will be clear to those skilled in the art, after reading this disclosure, how to make and use alternative embodiments of the present invention wherein conductive reflector sheet 720 is realized differently. For example and without limitation, conductive reflector sheet can be:

i. much larger than conductive ribbon 710,
ii. a solid block of conductive material,
iii. part of a metal structure that also provides mechanical support,
iv. part of the housing of an RFID system, or
v. a combination of i, ii, iii, or iv.

FIG. 8 depicts dual-cavity-antenna-with-dielectric 800 in accordance with a fourth illustrative embodiment of the present invention. Dual-cavity-antenna-with-dielectric 800 comprises: conductive sheets 810-1, 810-2, and 810-3, electrical connections 820-1 and 820-2, and dielectric material 830, interrelated as shown.

Electrical connections 820-1 and 820-2 perform the same functions as the curved portions of conductive ribbon 510 in the first illustrative embodiment of the present invention. Conductive sheet 810-1 performs the same function as middle part of ribbon 550 in the first illustrative embodiment of the present invention. Conductive sheets 810-2 and 810-3 performs the same functions as folded ends of ribbon 540-1 and 540-2 in the first illustrative embodiment of the present invention. In particular, conductive sheets 810-2 and 810-3 form two resonant cavities, respectively, together with conductive sheet 810-1.

Although the combination of conductive sheets 810-1, 810-2, and 810-3, and electrical connections 820-1 and 820-2 can be realized by folding a ribbon of conductive material similar to conductive ribbon 510 with sharp bends around dielectric material 830, it will be clear to those skilled in the art, after reading this disclosure, how to make and use alternative embodiments of the present invention that are realized in a different manner. For example and without limitation, electrical connections 820-1 and 820-2 can be realized as:

i. single wires or multiple wires,
ii. portions of sheet material bent in different shapes,
iii. single or multiple connections at single or multiple points along the edges of the interconnected sheets,
iv. separate sheets of conductor formed by a stamping process and press fitted together as desired
v. solder joints, screws, pins, or other electrically conductive fasteners,
vi. plated-through via holes,
vii. a combination of i, ii, iii, iv, v, or vi Furthermore, the electrical connections can extend over larger or smaller sections of one or more edges of the conductive sheets.

Although conductive sheets and conductive ribbons are depicted in the figures of this disclosure as solid sheets of electrically conductive material such as, for example, metal foil, it will be clear to those skilled in the art, after reading this disclosure, how to make and use alternative embodiments of the present invention wherein the conductive sheets and conductive ribbons are realized differently. For example, and without limitation, a conductive sheets or a conductive ribbon can:

i. be a grid of wires, or a mesh,
ii. be made of any conductive materials such as metals (e.g., copper, aluminum) or, for example, conductive ink, or conductive paint,
iii. be perforated with holes arranged at random or in a regular pattern,
iv. be a printed circuit board with one or more interconnection layers,
v. comprise notches or jagged edges,
vi. have an uneven or rough surface with bumps or lumps,
vii. comprise electronic components, such as, for example, resistors, capacitors or integrated circuits,
viii. comprise mechanical fasteners such as, for example, screws, nuts, or rivets,
ix. comprise solder joints, welds or other electrical or mechanical joints,
x. be an array of parallel wires substantially parallel to the prevailing direction of electrical currents within the sheet or ribbon.
xi. be a combination of i, ii, iii, iv, v, vi, vii, viii, ix, or x.

Although dielectric material 830 is shown in FIG. 8 as occupying most of the volume between sheet 810-1 and sheets 810-2 and 810-3, it will be clear to those skilled in the art, after reading this disclosure, how to make and use alternative embodiments of the present invention wherein only none of the volume or only a portion of the volume is occupied by dielectric material, or dielectric material extends beyond the volume between the conductive sheets. It will also be clear to those skilled in the art, after reading this disclosure, how to make and use variants of the illustrative embodiments set forth in this disclosure wherein part or all of the volume of space within one or both of the cavities comprises one or more dielectric materials.

Many different dielectric materials are known in the art for making resonant structures. For example, and without limitation, dielectric material 830 can be acetate, ABS (Acrylonitrile Butadiene Styrene) of various densities, polyphenylsulphone, polyethersulfone, polysulfone, PETG (Polyethylene Terephthalate Glycol), polycarbonate, teflon, polystyrene, difunctional epoxy resin (FR4), epoxy glass, or polyethylene.

Although values for the dimensions of conductive sheets 810-1, 810-2, and 810-3 and for the distances between them are not explicitly specified in FIG. 8, it will be clear to those skilled in the art, after reading this disclosure, how to make and use embodiments of the present invention with specific values for such dimensions and distances. For example, and without limitation, sheets 810-1, 810-2, and 810-3 might be arranged such that the distance between the plane of sheet 810-1 and the plane of sheet 810-2 is less than:

(i) the square root of the area of sheet 810-1, (ii) the square root of the area of sheet 810-2, and (iii) the square root of the area of sheet 810-3.

Also, sheets 810-1, 810-2, and 810-3 might be arranged such that the distance between the plane of sheet 810-1 and the plane of sheet 810-3 is less than:

(i) the square root of the area of sheet 810-1, (ii) the square root of the area of sheet 810-2, and (iii) the square root of the area of sheet 810-3.

FIG. 9 depicts dual-cavity-antenna-with-multiple-dielectrics-and-reflector 900 in accordance with a fifth illustrative embodiment of the present invention. Dual-cavity-antenna-with-multiple-dielectrics-and-reflector 900 comprises: conductive sheets 810-1, 810-2, and 810-3, electrical connections 820-1 and 820-2, conductive reflector sheet 720, and dielectric materials 930-1, 930-2, and 930-3, interrelated as shown.

Conductive sheets 810-1, 810-2, and 810-3, electrical connections 820-1 and 820-2 are identical to conductive sheets 810-1, 810-2, and 810-3, electrical connections 820-1 and 820-2 in FIG. 8, respectively. Conductive reflector sheet 720 is identical to conductive sheet 720 in FIG. 7 and it provides the same advantage as in the illustrative embodiment depicted in FIG. 7.

In this fifth illustrative embodiment of the present invention, the volume of space inside the two cavities is occupied by two layers of different dielectric materials, 930-1 and 930-2. The volume of space between conductive reflector 720 and conductive sheet 810-1 is occupied by dielectric material 930-3. It will be clear to those skilled in the art, after reading this disclosure, how to make and use alternative embodiments of the present invention wherein the volumes of space described in this paragraph are occupied by one or more dielectric materials arranged in one or more layers or in other geometric arrangements.

Figure 10:
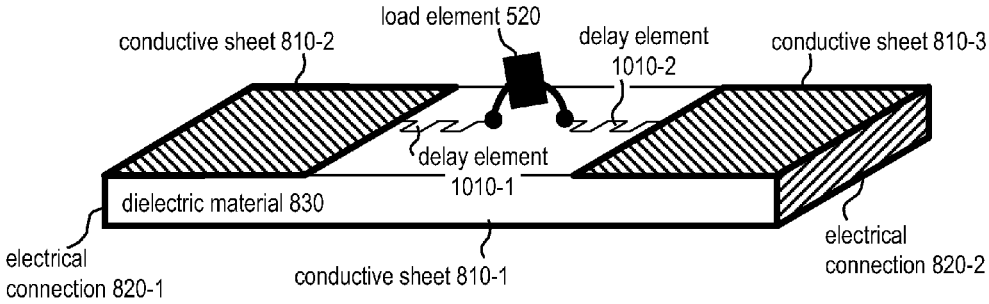
FIG. 10 depicts a dual-cavity antenna with delay elements in accordance with a sixth illustrative embodiment of the present invention.

FIG. 10 depicts dual-cavity-antenna-with-delay-elements 1000 in accordance with a sixth illustrative embodiment of the present invention. Dual-cavity-antenna-with-delay-elements 1000 comprises: conductive sheets 810-1, 810-2, and 810-3, electrical connections 820-1 and 820-2, dielectric material 830, load element 520, and delay elements 1010-1 and 1010-2, interrelated as shown.

Conductive sheets 810-1, 810-2, and 810-3, electrical connections 820-1 and 820-2 and dielectric material 830 are identical to conductive sheets 810-1, 810-2, and 810-3, electrical connections 820-1 and 820-2 and dielectric material 830 in FIG. 8, respectively. Load element 520 is identical to load element 520 in FIG. 5.

The salient difference between this illustrative embodiment and the previous illustrative embodiments is the way in which load element 520 is connected to conductive sheets 810-2 and 810-3. It is well known in the art how to make a delay element using a so-called "serpentine" structure, sometimes also referred-to as a "meandering" structure. Such a structure is depicted in FIG. 10 as implementing delay elements 1010-1 and 1010-2, and can be regarded as having an electrical behavior similar to an inductor or similar to a delay line. By connecting load element 520 through one or two such delay elements, it is possible to reduce the length of one or both resonant cavities without an increase in the resonant frequency. This is advantageous because, in the absence of such delay elements, a reduction in the size of a resonant cavity, if other cavity parameters are kept unchanged, is generally accompanied by an increase in the cavity's resonant frequency. In an alternative embodiment of the present invention, one or both of delay elements 1010-1 and 1010-2 can be serpentine ribbon structures with electric-field couplings to conductive sheets 810-2 or 810-3, respectively.

Although this disclosure sets forth embodiments of the present invention as applicable for implementing RFID systems, it will be clear to those skilled in the art, after reading this disclosure, how to make and use alternative embodiments of the present invention that are applicable to other types of radio-communication systems. For example, and without limitation, a radio receiver or transmitter characterized by a high input or output impedance can advantageously utilize an antenna in accordance with an embodiment of the present invention.

It is to be understood that this disclosure teaches just one or more examples of one or more illustrative embodiments, and that many variations of the invention can easily be devised by those skilled in the art after reading this disclosure, and that the scope of the present invention is to be determined by the following claims.

What is claimed is:

1. An apparatus comprising:

an antenna with a connection port;

a load element;

wherein the antenna comprises a ribbon of conductive material;

wherein a first end of the ribbon and a second opposite end of the ribbon are folded over the middle part of the ribbon;

wherein the folded first and second ends of the ribbon are on the same side of the middle part of the ribbon;

wherein the folded first and second ends of the ribbon are parallel to the middle part of the ribbon;

wherein the folded first end of the ribbon is at a first distance from the middle part of the ribbon, and the folded second end of the ribbon is at a second distance from the middle part of the ribbon;

wherein the outline shape of the folded first end of the ribbon does not extend beyond the outline shape of the middle part of the ribbon, and the outline shape of the folded second end of the ribbon does not extend beyond the outline shape of the middle part of the ribbon;

wherein both the first distance and the second distance are less than (i) the length of the ribbon, and (ii) the width of the ribbon; and wherein the folded first and second ends of the ribbon do not touch one another;

wherein the connection port comprises a first connection point on the first end of the ribbon and a second connection point on the second end of the ribbon; and wherein the load element is electrically connected between the first connection point and the second connection point.

2. The apparatus of claim 1 wherein the first distance is equal to the second distance.

3. The apparatus of claim 1 wherein the first folded end of the ribbon has the same length as the second folded end of the ribbon.

4. The apparatus of claim 1 wherein the first folded end of the ribbon has a length that is different from the length of the second folded end of the ribbon.

5. The apparatus of claim 1 wherein the load element comprises a rectifier for rectifying an electrical radiofrequency signal.

6. The apparatus of claim 1 wherein the load element comprises a device with a controllable radiofrequency impedance.

7. The apparatus of claim 1 wherein the volume of space between the first end of the ribbon and the middle part of the ribbon comprises a dielectric material.

8. The apparatus of claim 1 wherein the volume of space between the first end of the ribbon and the middle part of the ribbon comprises two dielectric materials.

9. The apparatus of claim 1 wherein the connection port further comprises at least one delay element in series with the first connection point.

10. The apparatus of claim 9 wherein the delay element is a serpentine structure.

11. The apparatus of claim 9 wherein the delay element is an inductor.

12. The apparatus of claim 1 further comprising a flat sheet of conductive material parallel to the middle part of the ribbon;

wherein the middle part of the ribbon is between the flat sheet of conductive material and the two folded ends of the ribbon.

13. An apparatus comprising:

a ribbon of conductive foil;

a load element;

wherein a first end of the ribbon and a second opposite end of the ribbon are folded over the middle part of the ribbon;

wherein the folded first and second ends of the ribbon are on the same side of the middle part of the ribbon;

wherein the folded first and second ends of the ribbon are parallel to the middle part of the ribbon;

wherein the folded first end of the ribbon is at a first distance from the middle part of the ribbon, and the folded second end of the ribbon is at a second distance from the middle part of the ribbon;

wherein the outline shape of the folded first end of the ribbon does not extend beyond the outline shape of the middle part of the ribbon, and the outline shape of the folded second end of the ribbon does not extend beyond the outline shape of the middle part of the ribbon;

wherein the first distance is at least 3 mm and at most 10 mm, and the second distance is at least 3 mm and at most 10 mm;

wherein the length of the ribbon is at least 200 mm and at most 300 mm;

wherein the width of the ribbon is at least 6 mm;

wherein the load element is electrically connected between the two folded ends of the ribbon through two ohmic electrical connections.

14. The apparatus of claim 13 wherein the first distance is equal to the second distance.

15. The apparatus of claim 13 wherein the conductive foil comprises copper, or aluminum, or conductive ink.

16. The apparatus of claim 13 wherein at least one of the two ohmic electrical connections comprises a delay element.

17. The apparatus of claim 16 wherein the delay element is a serpentine structure.

18. The apparatus of claim 13 wherein the load element comprises a resonant structure.

19. The apparatus of claim 13 further comprising a flat conductive surface parallel to the middle part of the ribbon;

wherein the flat conductive surface material and the two folded ends of the ribbon are on opposite sides of the middle part of the ribbon.

20. The apparatus of claim 19 wherein the flat conductive surface is part of a structure that provides mechanical support for the apparatus.

21. The apparatus of claim 19 wherein the flat conductive surface is part of a housing structure.

22. An apparatus comprising:

a first flat sheet of conductive material in a first plane;

a second flat sheet of conductive material in a second plane that is parallel to the first plane;

a third flat sheet of conductive material in a third plane that is parallel to the first plane and lies between the first plane and the second plane;

a first electrical connection between a portion of the edge of the second sheet and the first sheet;

a second electrical connection between a portion of the edge of the third sheet and the first sheet; and a connection port comprising a first connection point on the second sheet and a second connection point on the third sheet;

wherein the second sheet does not overlap the third sheet;

wherein the outline shape of the second sheet does not extend beyond the outline shape of the first sheet, and the outline shape of the third sheet does not extend beyond the outline shape of the first sheet;

wherein the distance between the first plane and the second plane is less than:

(i) the square root of the area of the first sheet, (ii) the square root of the area of the second sheet, and (iii) the square root of the area of the third sheet;

wherein the distance between the first plane and the third plane is less than:

(i) the square root of the area of the first sheet, (ii) the square root of the area of the second sheet, and (iii) the square root of the area of the third sheet; and wherein a load element is electrically connected between the first connection point and the second connection point.

23. The apparatus of claim 22 wherein the load element comprises a rectifier for rectifying an electrical radiofrequency signal.

24. The apparatus of claim 22 wherein the load element comprises a device with a controllable radiofrequency impedance.

25. An apparatus comprising:

a first flat sheet of conductive material in a first plane;

a second flat sheet of conductive material in a second plane that is parallel to the first plane;

a third flat sheet of conductive material in a third plane that is parallel to the first plane and lies between the first plane and the second plane;

a fourth flat sheet of conductive material in a fourth plane that is parallel to the first plane;

a first electrical connection between a portion of the edge of the second sheet and the first sheet;

a second electrical connection between a portion of the edge of the third sheet and the first sheet; and a connection port comprising a first connection point on the second sheet and a second connection point on the third sheet;

wherein the second sheet does not overlap the third sheet;

wherein the outline shape of the second sheet does not extend beyond the outline shape of the first sheet, and the outline shape of the third sheet does not extend beyond the outline shape of the first sheet;

wherein the distance between the first plane and the second plane is less than:

(i) the square root of the area of the first sheet, (ii) the square root of the area of the second sheet, and (iii) the square root of the area of the third sheet;

wherein the distance between the first plane and the third plane is less than:

(i) the square root of the area of the first sheet, (ii) the square root of the area of the second sheet, and (iii) the square root of the area of the third sheet; and wherein the first plane is between the third plane and the fourth plane.

26. The apparatus of claim 25 wherein the volume of space between the first sheet and the fourth sheet comprises a dielectric material.

27. The apparatus of claim 25 wherein the outline shape of the first sheet does not extend beyond the outline shape of the fourth sheet.

* * * * *